US008561540B1

(12) United States Patent
Lauch

(10) Patent No.: US 8,561,540 B1
(45) Date of Patent: Oct. 22, 2013

(54) ROTATING THUMB SAFETY FUZE FOR A HAND GRENADE AND RELATED METHODS OF OPERATION AND ASSEMBLY

(75) Inventor: Richard Lauch, Linden, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/339,473

(22) Filed: Dec. 29, 2011

(51) Int. Cl.
*F42B 27/00* (2006.01)
*F42C 15/188* (2006.01)
*F42C 15/20* (2006.01)

(52) U.S. Cl.
USPC ..... 102/258; 102/487; 102/261

(58) Field of Classification Search
USPC ..... 102/482, 487, 254, 256, 258, 260, 261
See application file for complete search history.

(56) References Cited

U.S. PATENT DOCUMENTS 2,203,640 A * 6/1940 Hines et al. ..... 102/261
2,562,928 A 8/1951 Lewis
3,434,421 A * 3/1969 Berlin et al. ..... 102/487
3,611,852 A 10/1971 Strilich
3,742,855 A * 7/1973 Webb ..... 102/487
3,823,669 A 7/1974 Zacharin
3,926,122 A 12/1975 Wolterman
4,063,514 A 12/1977 Hadfield
4,078,499 A 3/1978 Giraud
4,167,905 A 9/1979 Kosonocky et al.
4,513,667 A * 4/1985 Caruso ..... 102/487
H251 H 4/1987 Field
4,730,559 A 3/1988 Brightman
5,196,649 A 3/1993 DiRubbio et al.
5,355,803 A * 10/1994 Robinet et al. ..... 102/487
5,886,288 A * 3/1999 Brunn ..... 102/482
6,082,267 A 7/2000 Cooper
6,792,868 B2 * 9/2004 Teilhol et al. ..... 102/487
6,965,542 B1 11/2005 Harrington et al.
7,197,983 B2 4/2007 Barth et al.
7,712,419 B1 5/2010 Cheng et al.

* cited by examiner

*Primary Examiner* — James Bergin
(74) *Attorney, Agent, or Firm* — Michael C. Sachs

(57) ABSTRACT

A safety fuze for use with a canister, includes a body, a lever that is rotatably secured to one end of the body, a striker assembly that is rotatably secured to another end of the body, and a thumb switch assembly that includes a target and that is rotatably secured to the body. The safety fuze is selectively armed and disarmed. It is settable in one or four states: a safe-locked state; a safe-unlocked state; an armed state; and an initiation state.

20 Claims, 20 Drawing Sheets

ROTATING THUMB SAFETY FUZE FOR A HAND GRENADE AND RELATED METHODS OF OPERATION AND ASSEMBLY

GOVERNMENTAL INTEREST

The invention described herein may be manufactured and used by, or for the Government of the United States for governmental purposes without the payment of any royalties thereon.

FIELD OF THE INVENTION

The present invention relates in general to the field of munitions. More specifically, this invention relates to safety fuzes for hand emplaced grenades for military and commercial uses.

BACKGROUND OF THE INVENTION

Safety is a very important design aspect of a hand grenade fuze. Conventional fuze designs account for a time delay period from initiation, for the detonation to occur, in order to ensure that the grenade is cast outside the explosion hazard area.

To this end, numerous conventional hand grenade fuzes have been proposed, some of which are described in the following publications: U.S. Pat. Nos. 3,823,669; 3,926,122; 4,063,514; 4,167,905; 4,730,559; 5,196,649; 6,082,267; 6,965,542; 7,197,983; and 7,712,419, and Statutory Invention Registration H251, issued Apr. 7, 1987 to Field.

These and other fuze designs propose the use of delay elements that are either mechanically, chemically, electrically, or electro-magnetically operated. However, these conventional designs could present various inherent problems, particularly when used in the field, under adverse and stressful conditions.

More specifically, many conventional hand grenade fuze designs include an explosive train that is always in-line from production through employment, thus presenting an intrinsic danger of inadvertent initiation.

In addition, other fuzes are designed primarily for right handed users and require different grasp and inverted handling for left-handed users, thus increasing the possibility of slippage, "milking" and functioning within close proximity.

Conventional fuze designs do not provide a visual indication (e.g., color coded) of the fuze armed and unarmed states, thus increasing the risk of inadvertently confusing the armed state for the unarmed state and creating subjective disposition of unexploded and mishandled grenades.

Certain conventional fuze designs provide for two safety features that are not required to be performed in a specific order, thus increasing the risk of unintentional functioning.

Conventional fuze designs cannot be easily returned to a safe state by the user once the safety pin is removed. As a result, once the safety pin is removed, the grenade must be deployed, regardless of the user's intent.

Many conventional fuze designs use a safety pin as a primary safety, the pin is placed through the fuze body and the ends are either shaped into a diamond, duckbill, spread, etc. Safety pin removal forces of safety pins formed concurrently in the same machinery or means for the same batch or lot may vary up to 20 pounds. As a result, the user requirements vary and are unknown until the user removes the safety and may vary from 10 pounds to 30 pounds of force required or 300% of the minimal force.

Conventional fuze designs do not necessarily provide a fail safe feature on the primary safety. The primary safety of some of these designs can be easily modified or altered by the user, or damaged by impact. Consequently, reducing the effectiveness of the primary safety and creating a risk of unintentional initiation.

The fuze primary safety design is generally tested through destructive testing, and the results are based on the sample size and the statistical analysis of results, thus the results have a high confidence level but are never 100% for the lot.

Conventional fuze designs intend for the user to have a secure grip on the lever when removing the primary safety pin but have no mechanical means to ensure this condition exists. As a result, the primary safety pin may be removed and the grenade initiated without the user having control over the grenade.

The spatial constraints on existing fuze designs pose technical risk for incorporating electronic circuitry to accomplish the detonation delay with an out-of-line explosive train. For this reason, recent fuze designs try to mechanically keep the explosive train out-of-line until the grenade is armed, thus reducing the requirement of the timing device to have a provision for such a feature.

What is therefore needed is a fuze design that addresses the following and other concerns and provides a solution thereto: effectiveness of the primary safety, out-of-line requirement, visual indication of armed state, right handed design, resafe difficulties, potential alteration or damage to the primary safety, and destructive testing. Prior to the advent of the present invention, the need for such a fuze design has heretofore remained unsatisfied.

SUMMARY OF THE INVENTION

The present invention satisfies this need, and describes a safety fuze for hand emplaced grenades for military and commercial uses. The fuze is provided with an out-of-line explosive train. As used herein, "canister" or "grenade" includes but is not limited to a hand grenade, and may include explosive, smoke, chemical, incendiary, and non-lethal explosive, flash, stun and riot control.

The present safety fuze provides numerous advantages among which are the following:

The safety fuze provides an ambidextrous safety. Anecdotal reports indicate that the incidents of left-hand users dropping and "milking" hand grenades incorporating the present fuze design, thus allowing the striker to activate the charge unintentionally without releasing the lever, are more prominent for left-handed users. This condition is believed to be caused by the design intended to be held with the hinging axis of the lever at the top near the thumb and not the palm. As used herein "milking" refers to the user releasing the handle enough to allow the striker to initiate the delay mechanism without the user's knowledge.

The safety fuze also provides a means to test the squeeze pressure of the lever and break away force of the thumb switch 100% during manufacturing. This eliminates the sampling of production parts off the line and nearly eliminates the probability of an escape of a fuze that does not meet the specified forces.

The safety fuze creates a safety that requires two distinct actions to be performed in a specific order to arm.

The safety fuze provides a means to resafe the device after the fuze is armed. The resafe procedure generally includes rotating the thumb switch back to a safe-locked state while maintaining constant control of the lever. As used herein "Resafe" or "resafing" refers to returning the fuze to a safe state.

The safety fuze further provides a visual color coded indication of the armed and safe positions of the thumb switch.

The safety fuze provides assurance that the user has control of the lever before arming. The thumb switch will not rotate until the lever is squeezed, which mandates a firm grip on the safety fuze.

The safety fuze provides out-of-line explosive train until the user initiates the arming sequence just prior to deploying the grenade.

The safety fuze reduces the potential for field modification by the user and reduces the subjectivity of the disposition of condition code during turn in.

The safety fuze reduces and simplifies the steps required to deploy the grenade compared to current designs, resulting in faster deployment during training and combat environments.

The safety fuze is shaped and dimensioned such that it may be used with the current grenade body and requires no alteration to adapt.

These and other advantages are implemented by the present safety fuze that is generally comprised of a lever which is held captive by the protruding teeth of a rotating thumb switch.

The lever in turn holds back a striker or hammer under spring tension. The lever is forcibly held away from the body by means of a spring that engages it into the rotating thumb switch teeth and prevents rotation in a safe-locked state.

In this safe-locked state, the lever is not depressed against the body of the fuze, the lever is engaged to the thumb switch. The barrel that joins the thumb switch of the right and left sides contains an initiation and/or delay device, so that the target of the striker is rotated 90 degrees, away from the striker path, should the striker be released. As used herein, the terms "safe" and "safety" generally refer to the fact that if the fuze is accidentally dropped or handled, it will not be initiated.

To start the arming of the fuze, the lever is depressed against the grenade body, causing the teeth of the rotating thumb switch to be disengaged from the mating teeth of the lever, and freeing the thumb switch to be rotated by the user. In this safe-unlocked state, the target of the striker is still rotated 90 degrees, away from the striker path. The fuze can be resafed at this stage by releasing the lever.

After the lever is depressed it must be held against the grenade body as the user manually rotates the thumb switch in a predetermined direction (e.g., upward, regardless of whether the user is left handed or right handed). The thumb switch has a breakaway from un-arm position force that is created by a ball detent interfering in a cutout under the thumb switch edge.

In this armed state, the fuze lever is no longer restrained by the thumb switch. However, the fuze can be resafed at this stage by rotating the thumb switch in the opposite direction (e.g., downward), and then releasing the lever. In this armed state, the fuze is no longer safe in that if it is accidentally dropped or handled, it will be initiated.

When the thumb switch is fully rotated 90 degrees, the initiating device and/or delay device will be in-line with the point of contact of the striker, and the lever will no longer be restrained. If released, the lever will allow rotation of the striker to make contact with the initiating device. At this point in the operation, the fuze is in the armed state awaiting to be employed. As used herein, "to be employed," or "employment" refers to the user releasing the grip on the lever and allowing the lever to move unrestrained.

When the grenade is deployed, the thumb switch is fully rotated 90 degrees, the initiating device and/or delay device will be in-line with the point of contact of the striker, the lever is released and striker has rotated and made contact with the initiated device. At this point of operation, the fuze is in the initiated state. In this initiation state, the fuze is initiated and such initiation is irreversible.

BRIEF DESCRIPTION OF THE DRAWINGS

The above and other features of the present invention and the manner of attaining them, will become apparent, and the invention itself will be best understood, by reference to the following description and the accompanying drawings, wherein:

FIG. 3 comprises FIGS. 3A, 3B, 3C, 3D, and 3E, wherein FIGS. 3A, 3B, and 3C illustrates the safety fuze of FIG. 2 in a safe-locked state, wherein FIG. 3D is an enlarged isometric view of an initiator that forms part of a thumb switch assembly, and wherein

FIG. 4 comprises FIGS. 4A, 4B, 4C, and 4D, and illustrates the safety fuze of FIG. 2 in a safe-unlocked state, wherein

FIG. 5 comprises FIGS. 5A, 5B, 5C and 5D, and illustrates the safety fuze of FIG. 2 in an armed state, wherein

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1A:
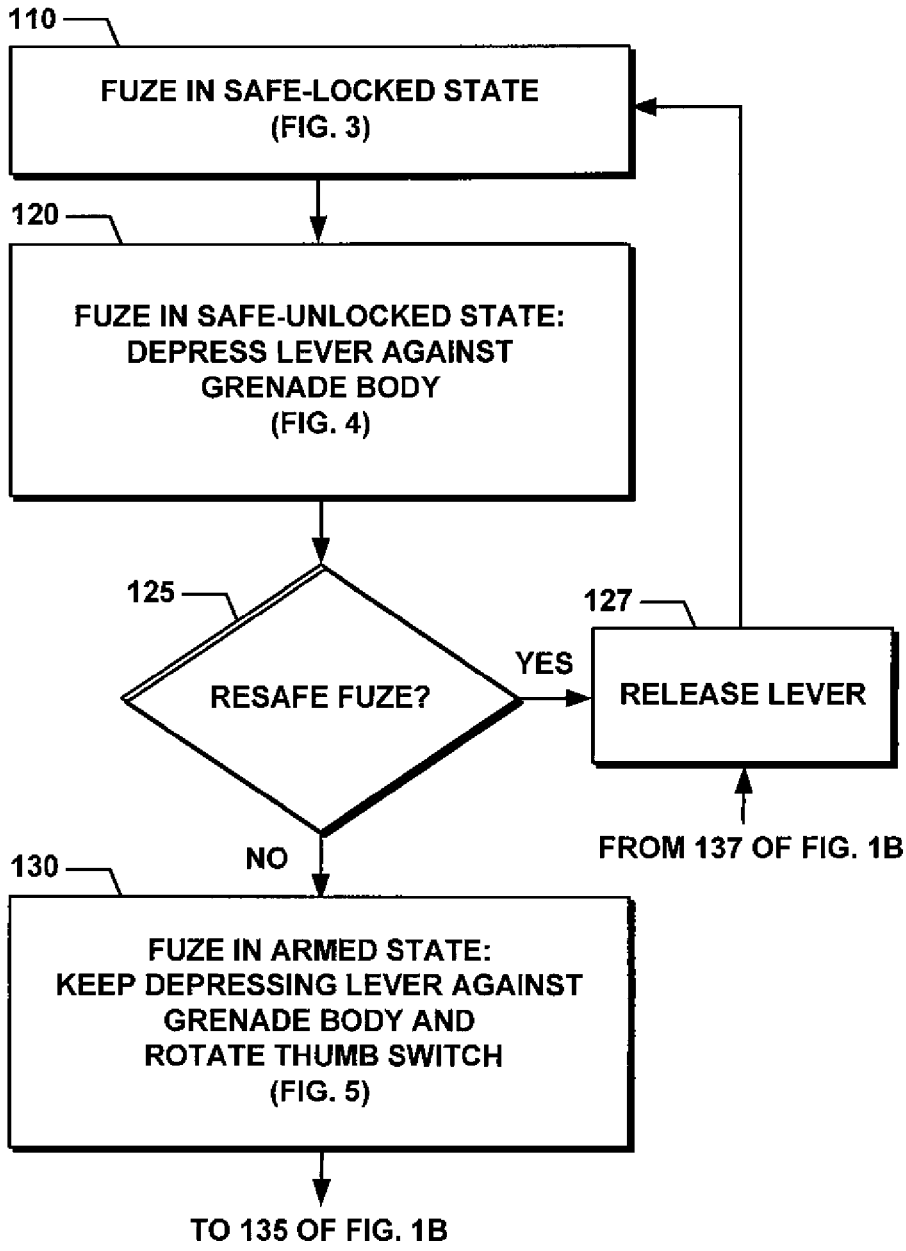
FIG. 1 comprises FIGS. 1A and 1B, and represents a flow chart illustrating the process of operation of a safety fuze according to the present invention.

A safety fuze 200 of the present invention and its method of operation will now be described with reference to FIGS. 1 and 2. The safety fuze 200 generally includes a lever 205, a body 210, a striker assembly 279, and a rotating thumb switch assembly 350.

The general operation 100 of the safety fuze 200 involves four distinct stages. In the first operation stage, the safety fuze 200 is in a safe-locked state, as shown in step 110 of FIG. 1A. As used herein, the terms "state," "position," or "stage" are used interchangeably. In this state, the lever 205 is locked in place by the rotating thumb switch assembly 350. In turn, the lever 205 holds back the striker assembly 279 under spring tension.

Figure 3A:
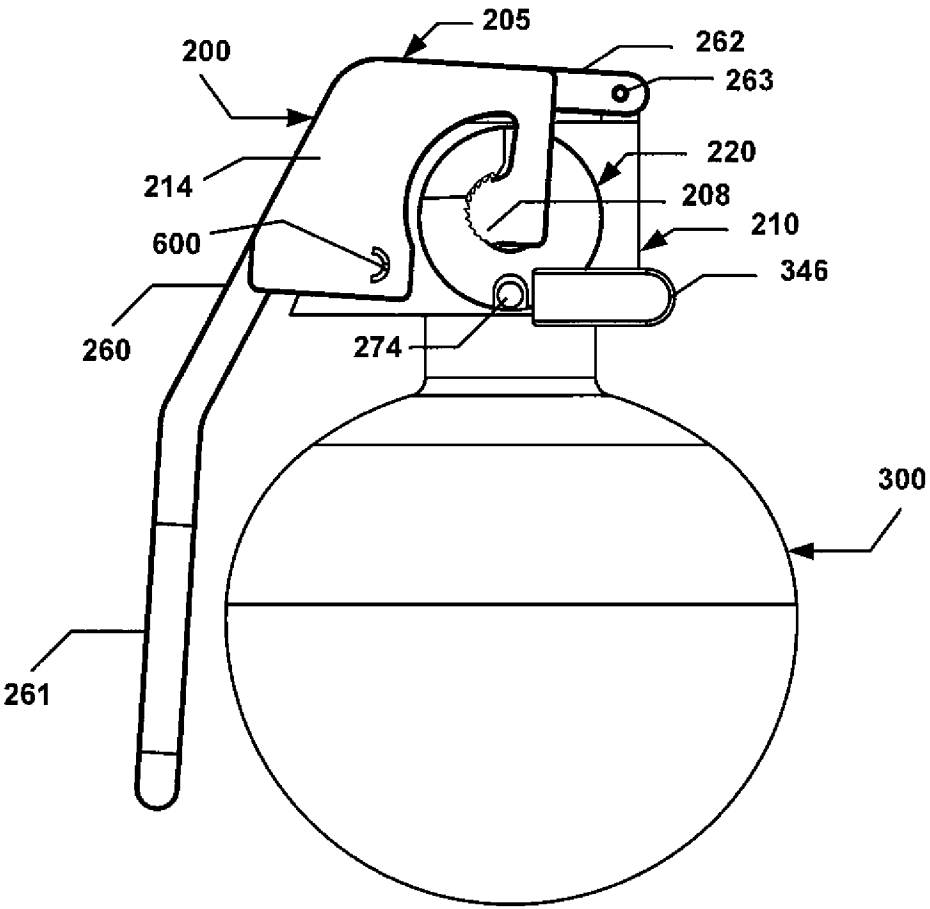

The lever 205 is held at a distance from the body 210 and prevented from rotation (e.g., FIG. 3A). In this safe-locked state, the rotating switch assembly 350 contains an initiation and/or delay device 355 (shown in dashed line in FIG. 3D), and is rotated 90 degrees away from a point of contact 280 of the striker assembly 279, should a striker 222 of the striker assembly 279 be released, making the explosive train out-of-line. While specific angles of rotation, i.e., 90 degrees, are stated herein, it should be understood that this exemplary value may be used in one preferred embodiment of the present invention, and that other angular values may be selected in other embodiments, which values are not limited to 90 degrees.

In the second operation stage, the safety fuze 200 is in a safe-unlocked state, as shown in step 120 of FIG. 1A. The safety fuze 200 is unlocked by depressing the lever 205 against a grenade 300 (e.g., FIG. 4A), which is secured to the body 210.

The depression of the lever 205 causes the thumb switch assembly 350 to become disengaged from the lever 205. The disengagement of the thumb switch assembly 350 will free it to be rotated manually by the user.

It is important to note that at this stage, the user has the full option to determine whether or not to resafe the safety fuze 200, at decision step 125 of FIG. 1A. If the user makes a determination to resafe the safety fuze 200, the safety fuze 200 can be readily resafed by having the user release the lever 205, at step 127 of FIG. 1A. The lever 205, being under spring tension, returns to its initial position, causing the safety fuze 200 to return to the safe-locked state of step 110.

If, at decision step 125, the user decides to pursue the arming of the safety fuze 200, he or she proceeds to the third operation stage. At this stage, the safety fuze 200 is in an armed state, as shown in step 130 of FIG. 1A.

After the lever 205 is depressed at step 120, it must be held against the grenade 300 as the user manually rotates the thumb switch assembly 350, for example a quarter turn (e.g., 90 degrees), in a predetermined direction. In one preferred embodiment, such predetermined direction is the upward direction, regardless of whether the user is left handed or right handed.

Figure 5A:
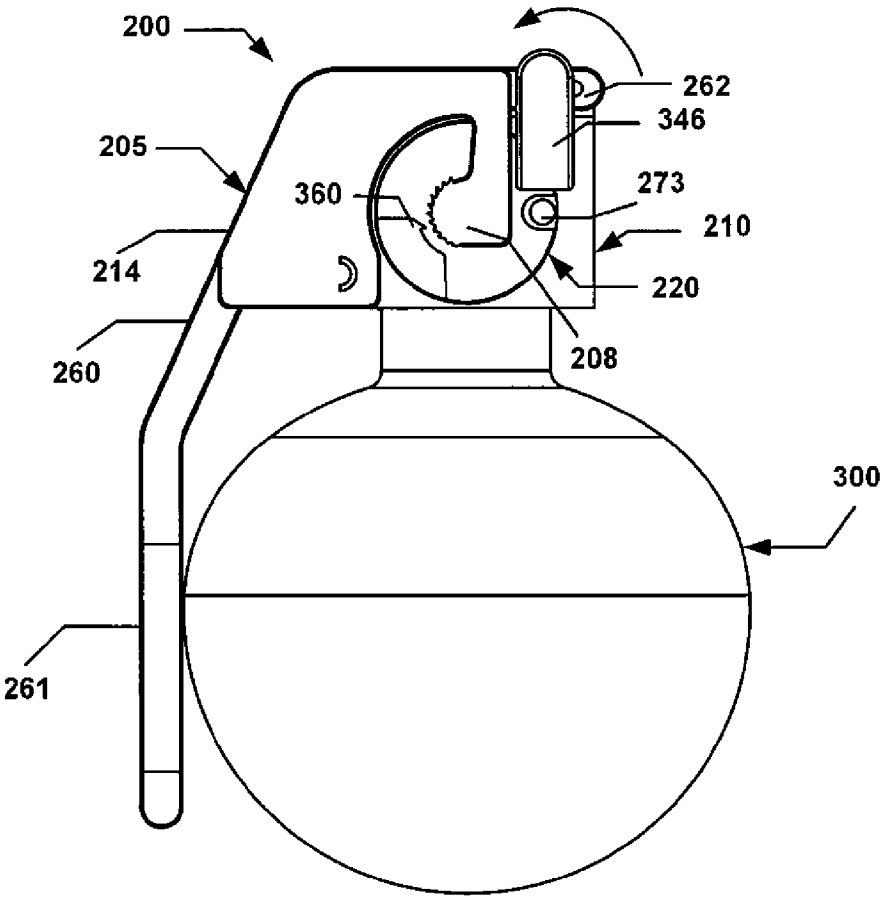
Figure 5B:
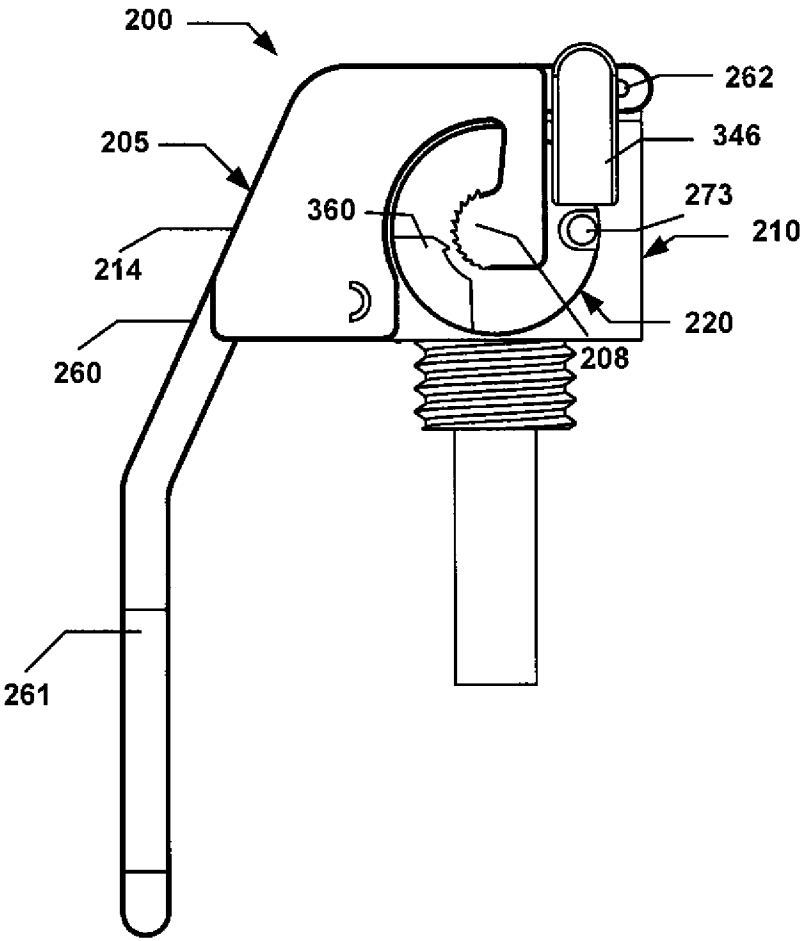
Figure 5C:
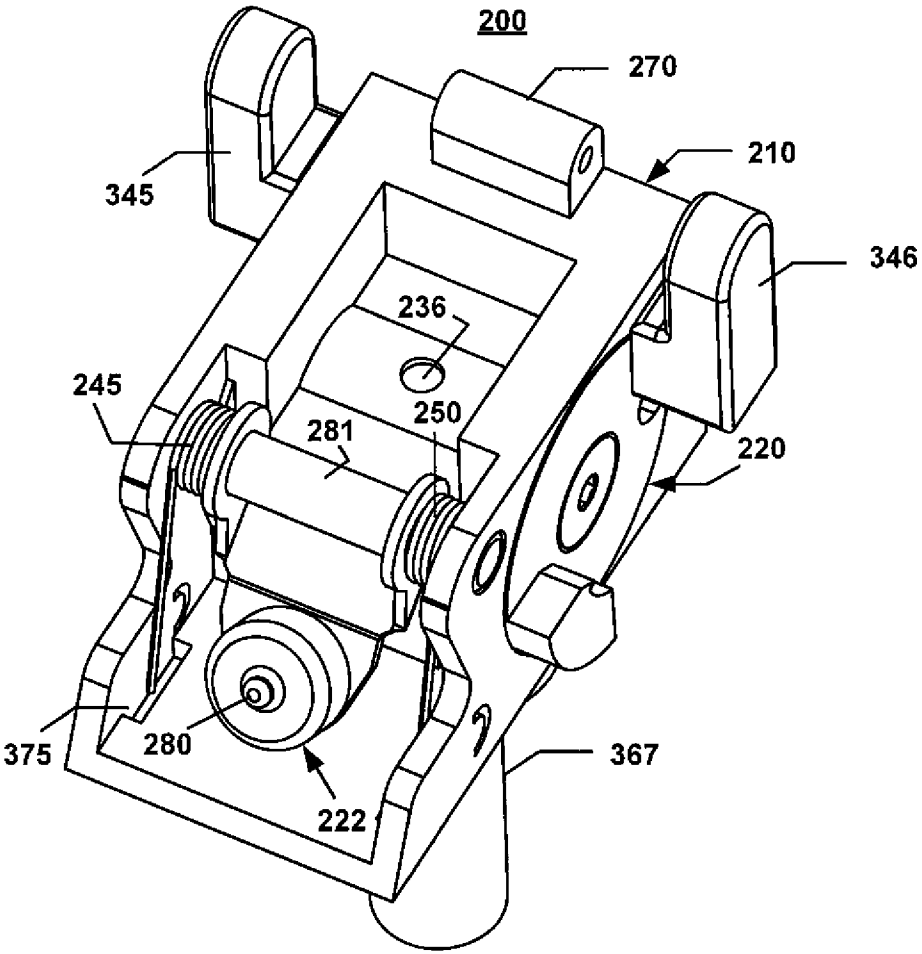

When the thumb switch assembly 350 is fully rotated 90 degrees, the initiating device and/or delay device 355 will be in-line with the point of contact 280 of the striker assembly 279, and the lever 205 will no longer be restrained (e.g., FIG. 5A).

Figure 1B:
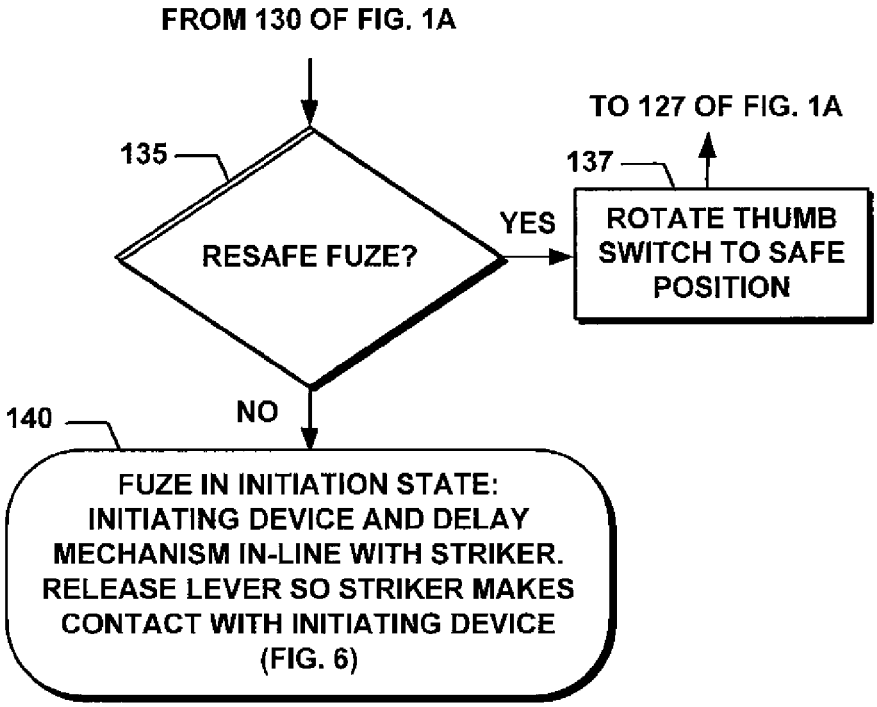

It is also important to note that at this stage, the user still has the full option to determine whether or not to resafe the safety fuze 200, at decision step 135 of FIG. 1B. If the user makes a determination to resafe the safety fuze 200, the safety fuze 200 can be readily resafed by sequentially rotating the thumb switch assembly 350 in the opposite direction (e.g., downward), as shown in step 137 of FIG. 1B, and then releasing the lever 205, as shown in step 127 of FIG. 1A. The lever 205 returns to its initial position, causing the safety fuze 200 to return to the safe-locked state of step 110.

If, however, at decision step 135, the user decides to pursue the arming of the safety fuze 200, he or she proceeds to the fourth operation stage. At this stage, the safety fuze 200 is in an initiation state, as shown in step 140 of FIG. 1B.

Figure 6A:
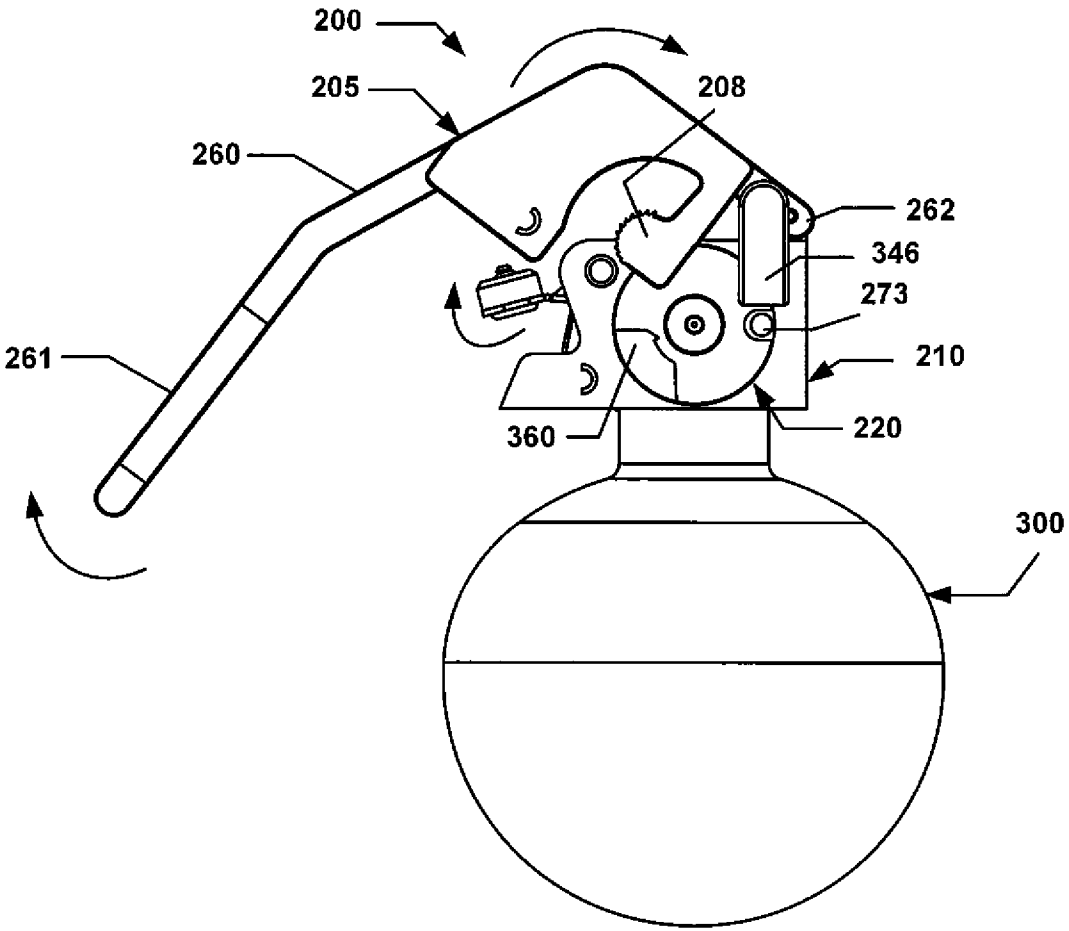
FIG. 6 comprises FIGS. 6A, 6B, and 6C, and illustrates the safety fuze of FIG. 2 in an initiation state.

At this final operation stage, the user releases the lever 205, allowing the lever 205 to move unrestrained, which will cause the rotation of the striker assembly 279 to make contact with the initiating device 355. At this point, the grenade 300 is initiated, and the safety fuze 200 can no longer be resafed. (e.g., FIG. 6A)

The method of assembling the safety fuze 200 will now be described with specific reference to FIGS. 2 and 3. The assembly method generally includes three steps: Assembling the striker assembly 279 to the fuze body 210; assembling the thumb switch assembly 350 to the fuze body 210; and assembling the lever 205 to the fuze body 210. Each of these assembly steps will now be described in greater detail.

The striker assembly 279 includes the following components: A striker 222, a striker spring 258, a rod 281, and two lever springs 245, 250. The striker 222 is provided with two shoulders 282A and 282B that extend from a striker body 223. Two axially coaligned holes are formed in the shoulders 282A, 282B, and are dimensioned to allow the rod 281 to pass therethrough, so that, upon assembly, the striker 222 can rotate freely around the axis of rod 281.

The striker assembly 279 is assembled to the body 210 by aligning the following elements and components in the following order: a first hole 285 formed in the safety fuze body 210, a first hole that is formed in the striker shoulder 282B, the lever spring 245, the striker spring 258, a second hole that is formed in the striker shoulder 282A, the lever spring 258, and the second hole 284 that is formed in the safety fuze body 210. This alignment is shown in the exemplary FIG. 3C, with the striker spring 258 and the lever 205 removed for clarity of illustration.

Figure 2:
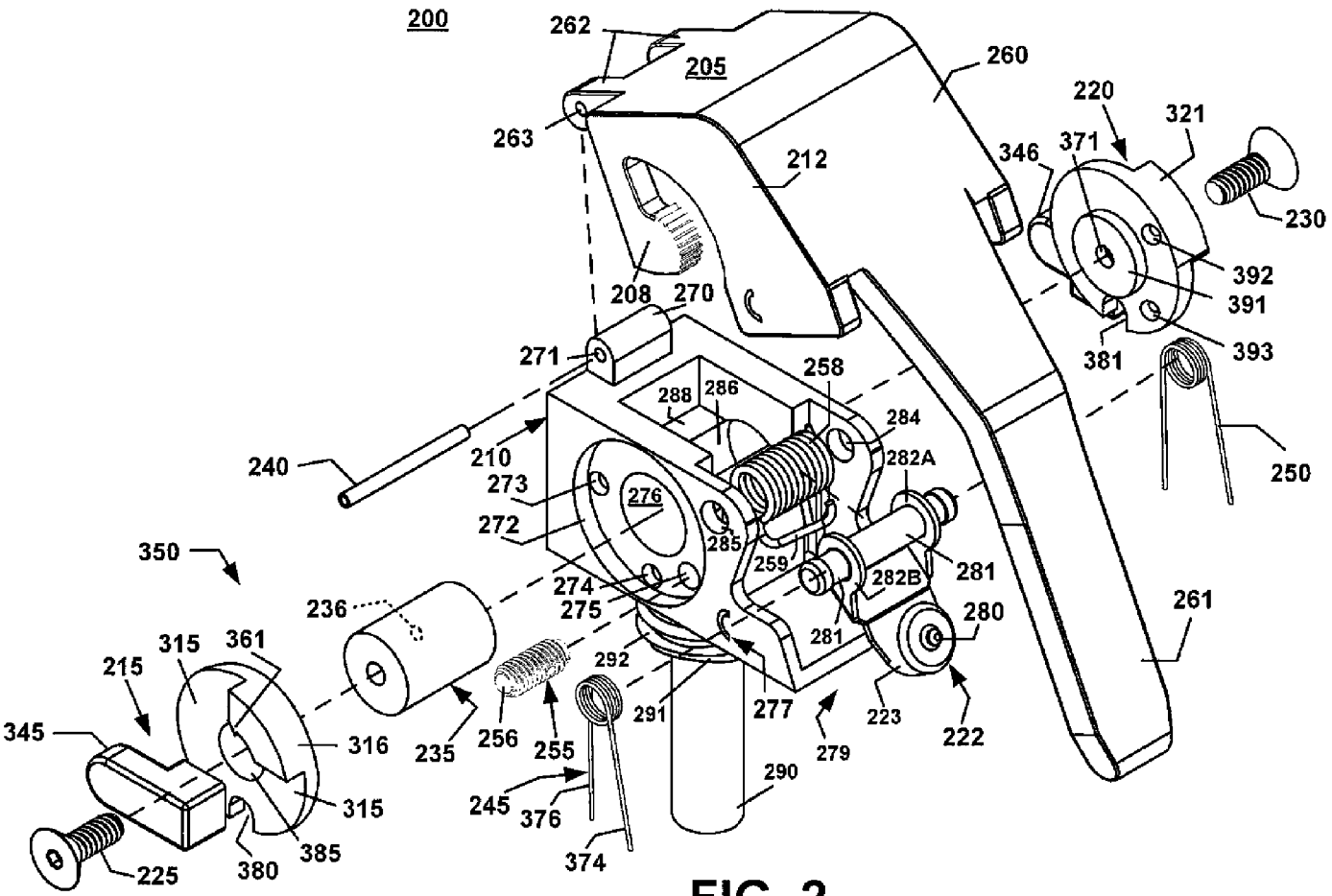
FIG. 2 is an exploded view of the safety fuze of the present invention.
Figure 3B:
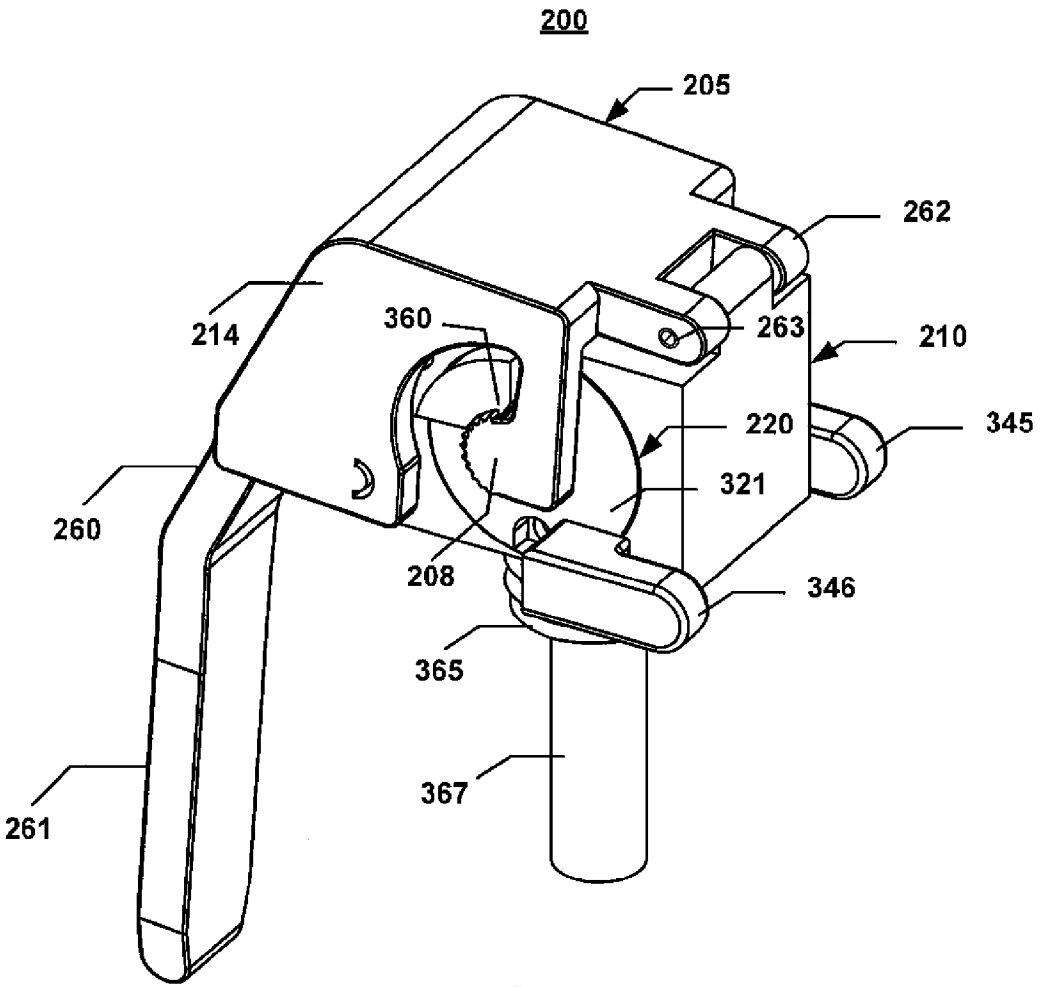
Figure 3C:
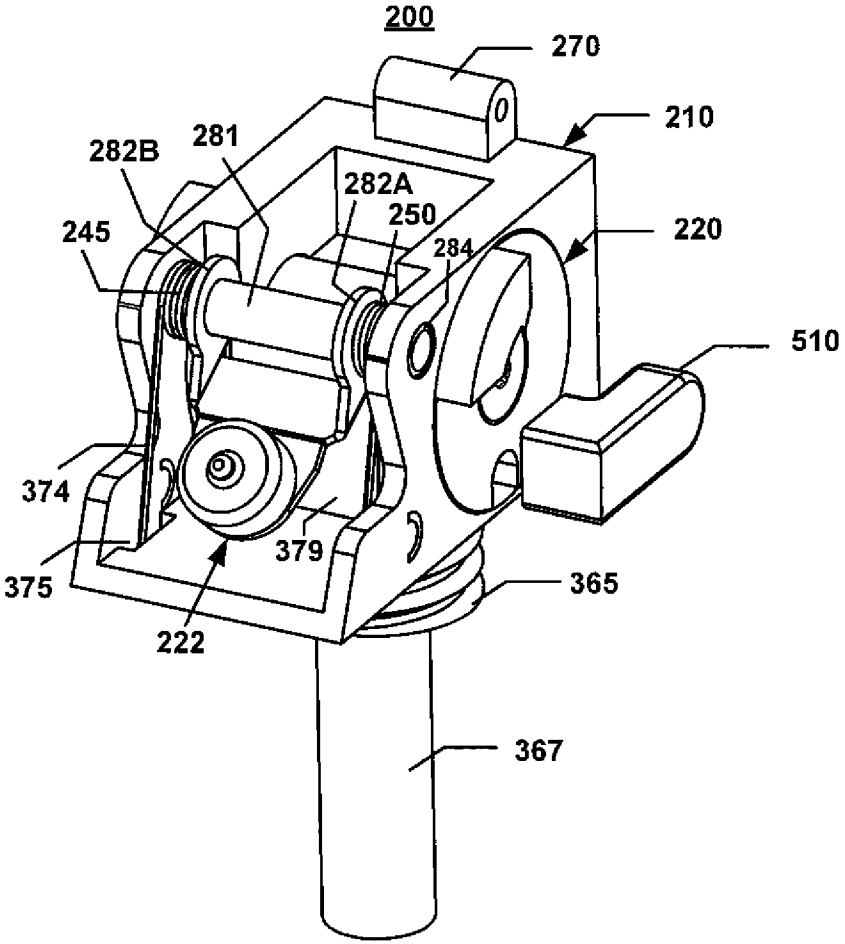

As further illustrated in FIG. 3C one terminal end 374 of the lever spring 245 is fitted in a corresponding cavity 375 that is formed in the body 210, for retaining the lever spring 245 in position. The other terminal end 376 (FIG. 2) of the lever spring 245 rests on, and is forced against a surface 379 (FIG. 3C) of the safety fuze body 210. The lever spring 250 is generally similarly shaped and dimensioned as the lever spring 245, and is also similarly assembled to the safety fuze body 210.

The lever springs 245, 250 determine the resistance force required to be overcome by the user's grip on the lever 205. This safety measure ensures that the lever 205 is not accidentally depressed by a casual force. The lever springs 245, 250 exert sufficient force on the lever 205, so that the lever teeth 208 engage the teeth 360, 361 of the thumb switch assembly 350.

The rod 281 is fitted in the body holes 284, 285, the lever springs 245, 250, the holes in the shoulders 282A, 282B, and the striker spring 258. The rod 281 protrudes on both sides of the striker shoulders 282A, 282B and rotates freely along the alignment axis defined by the rod 281.

The rod 281 is prevented from sliding out of position by the two flanges 212 (FIG. 2), 214 (FIG. 3A) of the lever 205, when the lever 205 is assembled to the safety fuze body 210.

At this stage, the striker 222 is held into a retracted position (FIG. 3C), and the fuze 200 is in a safe state.

Prior to describing the assembly of the thumb switch assembly 350 to the safety fuze body 210, the components of the thumb switch assembly 350 will be described with more specific reference to FIGS. 2 and 3D. The thumb switch assembly 350 is comprised of two similarly shaped and dimensioned thumb switches 215, 220, a barrel 235, a detent device 255, and two retaining screws 225, 230.

Figure 3D:
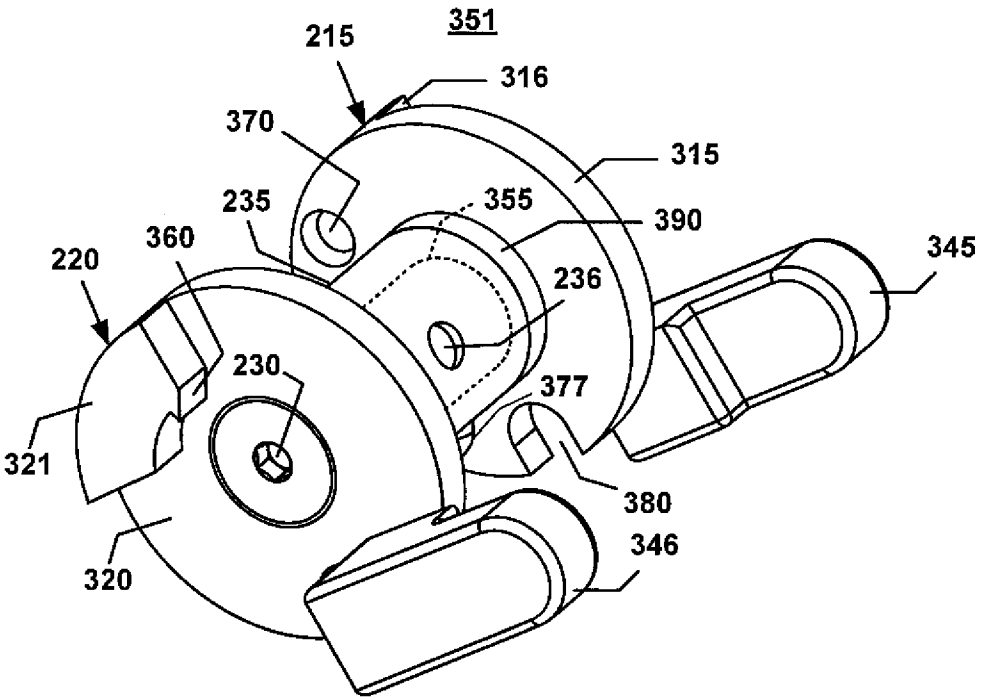

With reference to FIGS. 2 and 3D, the thumb switch 215 is formed of a generally cylindrically shaped body 315 that integrally extends from a front side of the shaped body 315 into a raised section 316. The raised section 316 terminates in a tooth 361 that is dimensioned to engage the teeth 208 of the lever 205.

The body 315 also includes another raised section (or flange) 390 that is centrally located and that extends from the backside of the body 315. The raised section 390 has a generally circular cross-section that is similar to that of the barrel 235, so that when the initiator 351 of FIG. 3D is assembled, the raised section 390 is flush with the barrel 235, in order to permit a smooth rotation of the initiator 351.

An axial opening 385 (FIG. 2) is formed through the depths of the body 315 and the circular raised section 390, in order to accommodate the retaining screw 225. It should be understood that the retaining screws 225, 230 may be replaced by any suitable or available pinning or another means to attach the assembly. The body 315 includes a generally semi-circular notch or opening 380 that extends throughout the depth of the body 315 to provide the user with a visual indication of the safety state of the fuze 200.

In this regard, the safety fuze body 210 includes two similar circular openings 273, 274 in which color indicators are inserted. In the present exemplary embodiment, a green color indicator is inserted in opening 274 to provide the user with a visual safe (or unarmed) mode indicator (steps 110-120 of FIG. 1A). A red color indicator is inserted in opening 273 to provide the user with a visual armed indicator (step 130 of FIG. 1A and step 140 of FIG. 1B).

In a preferred embodiment, the circular openings 273, 274 are distanced by 90 degrees, so that when the initiator 351 is rotated by 90 degrees, the visual indicator changes from the green color to the red color (or vice versa), to indicate a change in the mode (or state) of the fuze 200.

FIG. 2 shows the backside of the thumb switch 220 as including two similar circular openings 392, 393 that selectively engage the detent device 255. The detent device 255 is fitted within the opening 275 in the safety fuze body 210 so that the tip of a ball 256 protrudes outwardly relative to the fuze body 210.

In a preferred embodiment, the circular openings 392, 393 are distanced by 90 degrees, so that when the initiator 351 is rotated by 90 degrees, the detent device 255 is disengaged from the opening 393 and engages the opening 392 (or vice versa), depending on the safety mode of the fuze 200.

The ball 256 of the detent device 255 selectively engages either one of the two circular openings 392, 292, to lock the thumb switch assembly 350 in position. More specifically, the detent device 255 engages the opening 393 at steps 110 and 120 of FIG. 1A, while it engages the opening 392 at step 130 of FIG. 1A and step 140 of FIG. 1B).

The thumb switch 215 is generally, but not necessarily similar in design and construction to the thumb switch 220, and may include similar openings 370, 377 (FIG. 3D) to engage the detent device 255 or another detent device.

The thumb switch 220 is formed of a generally cylindrically shaped body 320. The front side of the body 320 that integrally extends into a raised section 321. The raised section 321 terminates in a tooth 360 that is dimensioned to engage the teeth 208 of the lever 205.

The backside of the body 320 includes a raised section 391 that is centrally located. The raised section 391 has a generally circular cross-section that is similar to that of the barrel 235, so that when the initiator 351 of FIG. 3D is assembled, the raised section 391 is flush with the barrel 235, in order to permit a smooth rotation of the initiator 351.

An axial opening 371 is formed through the depths of the body 320 and the circular raised section 391 of the thumb switch 220, in order to accommodate the retaining screw 230. The body 320 includes a generally semi-circular notch or opening 381 that extends throughout the depth of the body 320, to provide the user with a visual indication of the safety state of the fuze 200.

In this regard, the safety fuze body 210 may optionally include two similar circular openings 273, 274 in which color indicators are inserted. In the present exemplary embodiment, a green color indicator is inserted in the opening 274 to provide the user with a visual safe (or unarmed) mode indicator (steps 110-120 of FIG. 1A). A red color indicator is inserted in the opening 273 to provide the user with a visual armed indicator (step 130 of FIG. 1A and step 140 of FIG. 1B). In a preferred embodiment, the circular openings 273, 274 are distanced by 90 degrees.

To assemble the initiator 351 to the safety fuze body 210, the initiation and/or delay device 355 is housed in the barrel 235. The barrel 235 is then fitted inside a cylindrical chamber 286 (FIG. 2) of the safety fuze body 210, through an opening 276 in the safety fuze body 210. The barrel 235 fits rotatably, with restrained clearance, within the chamber 286.

In this exemplary embodiment, the barrel 235 is cylindrically shaped. Upon assembly to the safety fuze body 210, a target 236 in the barrel 235, is positioned forward relative to user, so that when the fuze is in a safe state, the target 236 is positioned orthogonally (out-of-line) relative to the striking path of the striker point of contact 280.

The two thumb switches 215, 220 are fitted to the barrel 235 on either side of the fuze body 210. With reference to FIG. 2, the body 315 of the thumb switch 215 fits rotatably, with restrained clearance, within a similarly shaped and dimensioned circular opening 272 in the safety fuze body 210, with the tooth 361 protruding outward relative to the safety fuze body 210. The thumb switch 220 is similarly fitted to the safety fuze body 210.

The thumb switches 215, 220 are then secured to the safety fuze body 210 and the barrel 235 by two fastening means, such as screws 225, 230, respectively, such that the ball of the detent 255 fits within a corresponding opening, e.g., 274, in order to exert a predetermined force on the thumb switch 215. A similar defent device may be fitted for the thumb switch 220. The detent device (or devices) 255 positions the thumb switches 215 and 220 in a safe position, so that upon squeezing the lever 205, there will still remain a resistance on the thumb switch 205 required to rotate it into the armed state.

At this stage, the assembled two thumb switches 215, 220 and the barrel 235 are rotatable as an integral unit, referred to herein as the initiator 351 (FIG. 3D), by means of any one of the two thumb levers 345, 346 that are secured to the bodies 315, 320, respectively. Upon countering the retention force of the ball detente 255 by the user, the initiator 351 is free to rotate, axially, in one direction for exposing the target 236 to the striker point of contact 280.

The lever 205 is then assembled by aligning the lever holes 262 with an axial hole 271 in a hinge section 270 of the safety fuze body 210. A dowel 240 is inserted in the holes 262, 271 to rotatably secure the lever 205 to the lever body 210, around an axis that is defined by the dowel 240. Alternative fastening and rotation means may be used instead.

The teeth 208 of the lever 205 are interlocked, in a mating relationship, with the teeth 360, 361 of the initiator 351 (i.e., thumb switches 220, 215, respectively), as long as the lever 205 is not pressed against the grenade 300.

By depressing the lever 205, the teeth 208 of the lever 205 disengage from the teeth 360, 361 of the initiator 351, allowing the initiator 351 to be rotated, and the safety fuze 200 to be armed as described herein in connection with FIG. 1.

With reference to FIGS. 3B and 3C, the safety fuze body 210 extends into a downward threaded section 365, which, in turn, extends downward into a shaft 367. The grenade 300 is secured to the safety fuze 200 by inserting the shaft 367 into the grenade 300 and by threading the grenade 300 to the threaded section 365.

Upon completion of the assembly of the safety fuze 200, and securing the grenade 300 thereto, the safety fuze 200 is in the safe-locked state, as shown in step 110 of FIG. 1A and FIG. 3, and is ready for packaging, shipment, and use.

FIG. 3A illustrates the safety fuze 200 and the grenade 300 in the safe-locked state. In this state, the lever 205 is locked in place by the rotating thumb switch assembly 350. More specifically, the teeth 360 361 of the initiator 351 are interlocked with the teeth 208 of the lever 205, as more clearly illustrated in FIG. 3B.

Figure 3E:
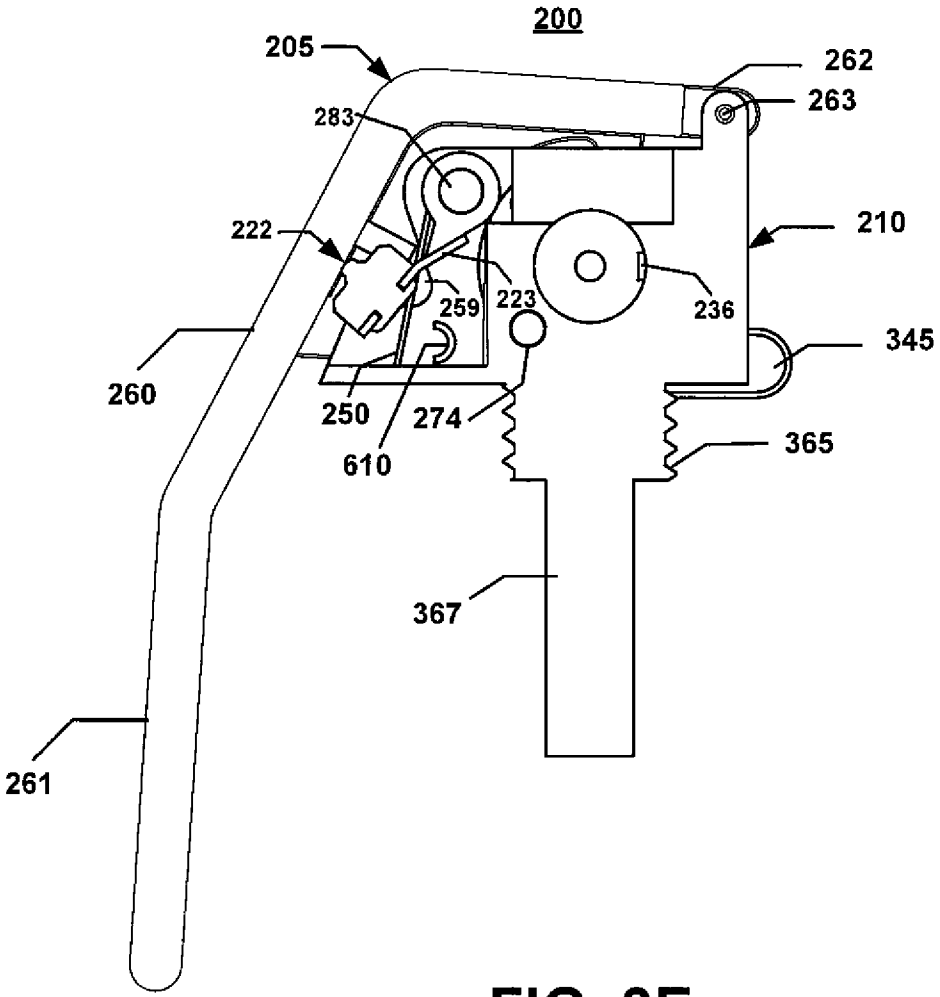
FIG. 3E is a side elevational view of the safety fuze with certain components removed for clarity of illustration.

As further illustrated in FIG. 3E, the lever 205, in turn, holds back the striker 222 under the tension of the striker spring 258. In this regard, the striker spring 258 terminates in a coil torsion spring 259 (also shown in FIG. 2) that acts on the underside of the striker 222 to force it against the underside of a lever platform 260.

The lever 205 is held at a distance from the body 210 and prevented from rotation. In this safe-locked state, the target 236 of the initiator 351 (shown in FIG. 3D) is rotated 90 degrees away from the point of contact 280 of the striker assembly 279 should the striker 222 be accidentally released, making the explosive train out-of-line, as illustrated in FIGS. 3C and 3E.

In this safe-locked state, the visual safe mode indicator 274 (FIG. 3A) provides the user with a confirmation of the safety state of the fuze 200. The two thumb levers 345, 346 are in the forward position.

The safe-unlocked state of the safety fuze 200 is shown in step 120 of FIG. 1A and FIG. 4. To arm the safety fuze 200, the lever 205 is depressed against the grenade 300 (e.g., FIG. 4A) that is secured to the safety switch body 210.

Figure 4A:
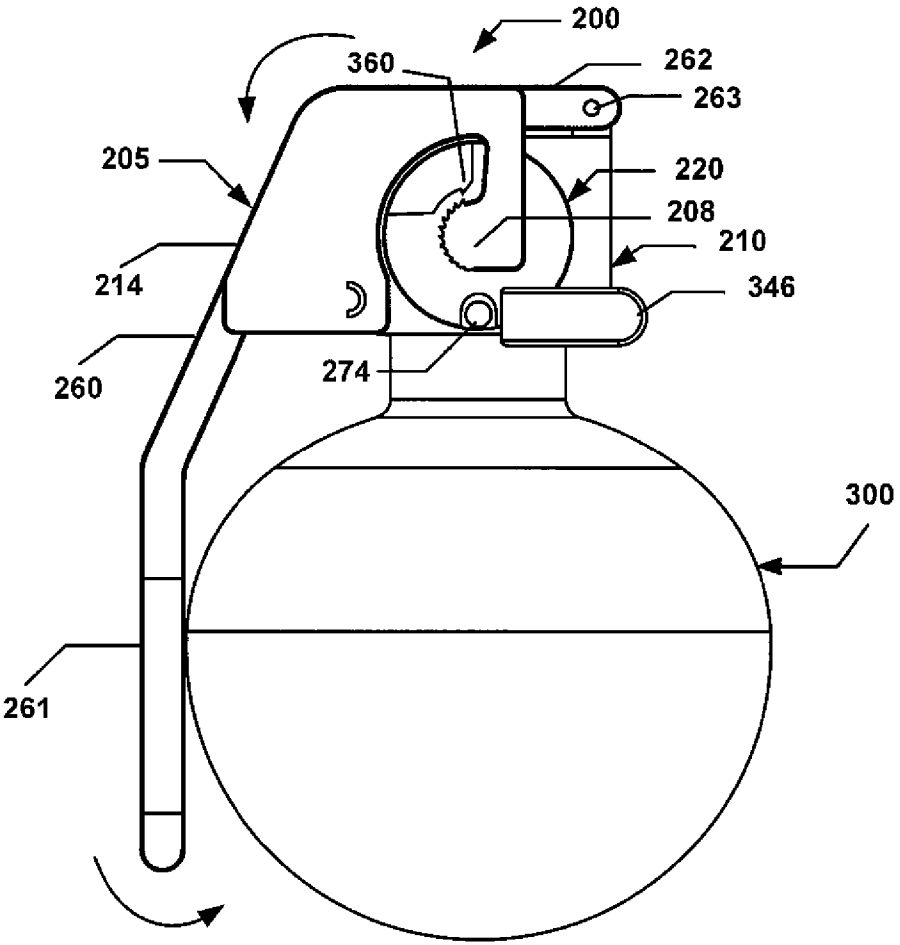
Figure 4B:
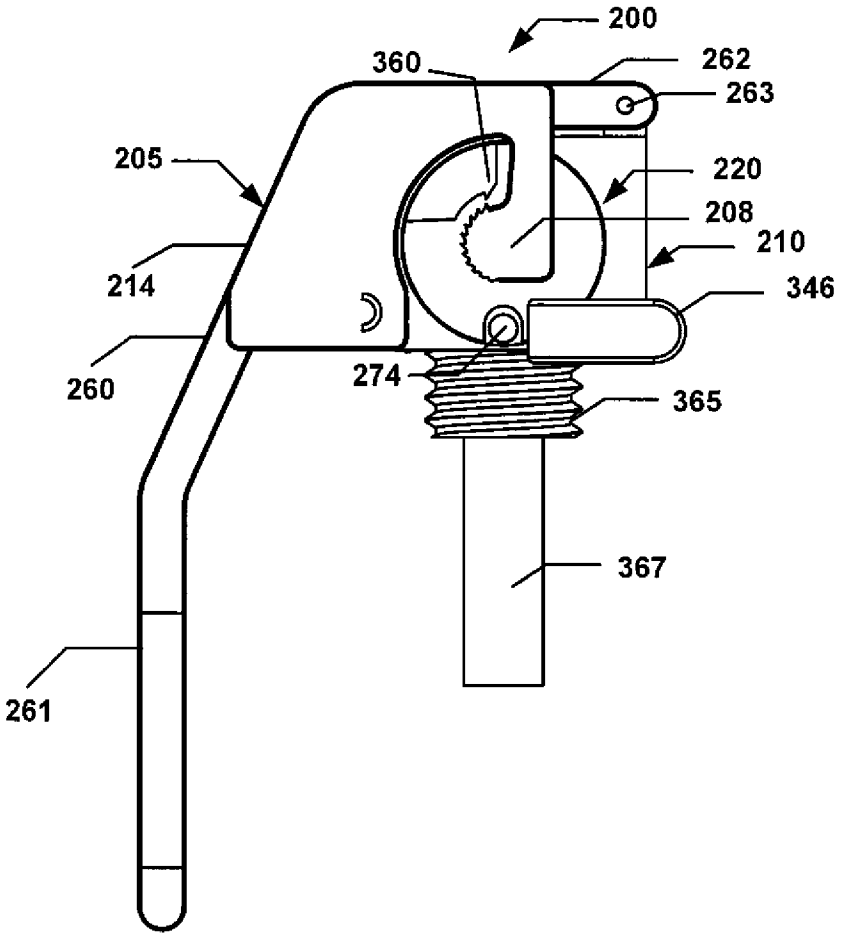

As illustrated in FIG. 4A, the user's depression of the handle 261 of the lever 205, causes the thumb switch assembly 350 to become disengaged from the lever 205 and free to be manually rotated by the user, along the direction of the arrow. This causes the teeth 360, 361 of the initiator 351 to disengage from the teeth 208 of the lever 205.

Figure 4C:
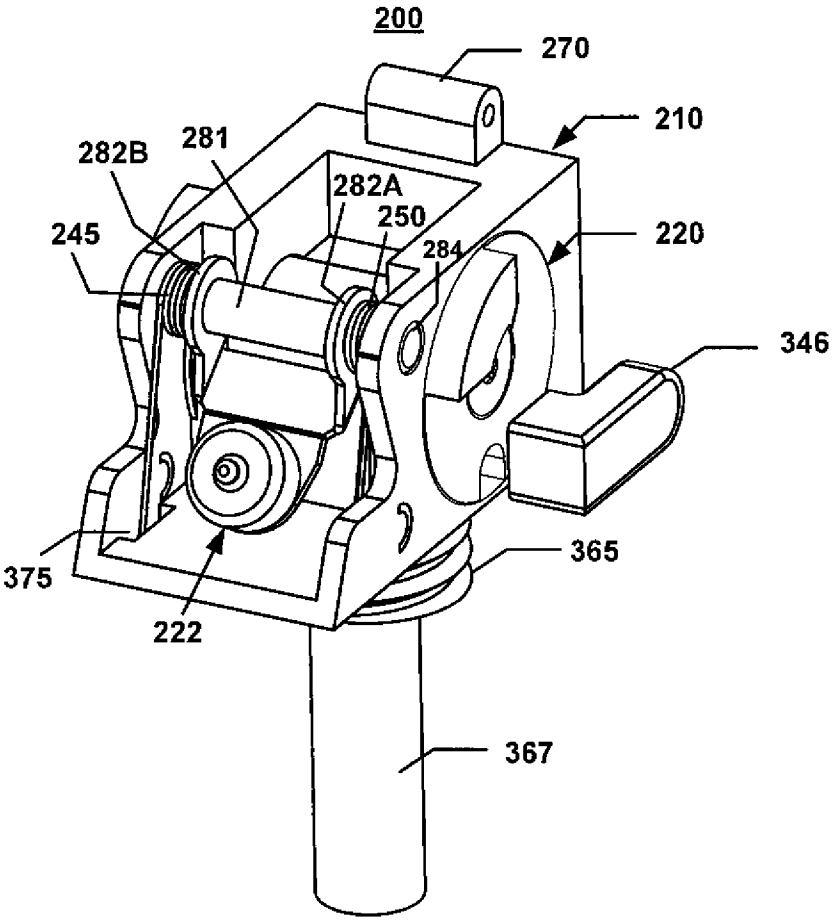
Figure 4D:
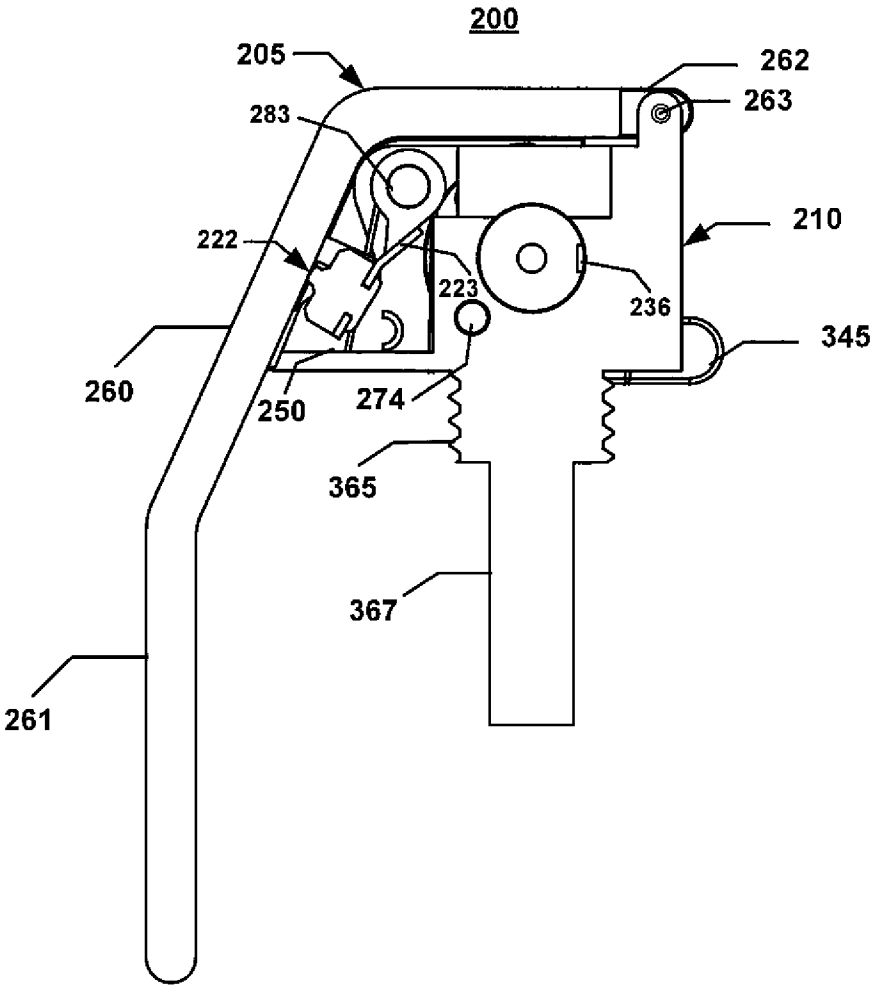
FIG. 4D is a side elevational view of the safety fuze with certain components removed for clarity of illustration.

With reference to FIG. 4D, as the lever 205 is pressed closer to the body 210, the lever platform 260 applies added force onto the striker 222, further tensioning the striker spring 258, in preparation for the possible rotation of the striker 222 toward the target 236.

In this safe-unlocked state, the target 236 of the initiator 351 (shown in FIG. 4D) is still rotated 90 degrees away from the point of contact 280 of the striker assembly 279 should the striker 222 be accidentally released, making the explosive train still out-of-line, as illustrated in FIGS. 4C and 4D.

The visual safe mode indicator 274 (FIGS. 4A, 4B, 4D) provides the user with a confirmation of the state of the fuze 200. The two thumb levers 345, 346 are in the forward position.

The armed state of the safety fuze 200 is shown in step 130 of FIG. 1A and FIG. 5. To further pre-arm the safety fuze 200, the lever 205 is kept depressed (as described earlier in connection with FIG. 4) while either one of the two thumb levers 345, 346 is rotated upward along the direction of the arrow. This causes the thumb switch assembly 350 to rotate, for example a quarter turn (e.g., 90 degrees), in the upward direction.

Figure 5D:
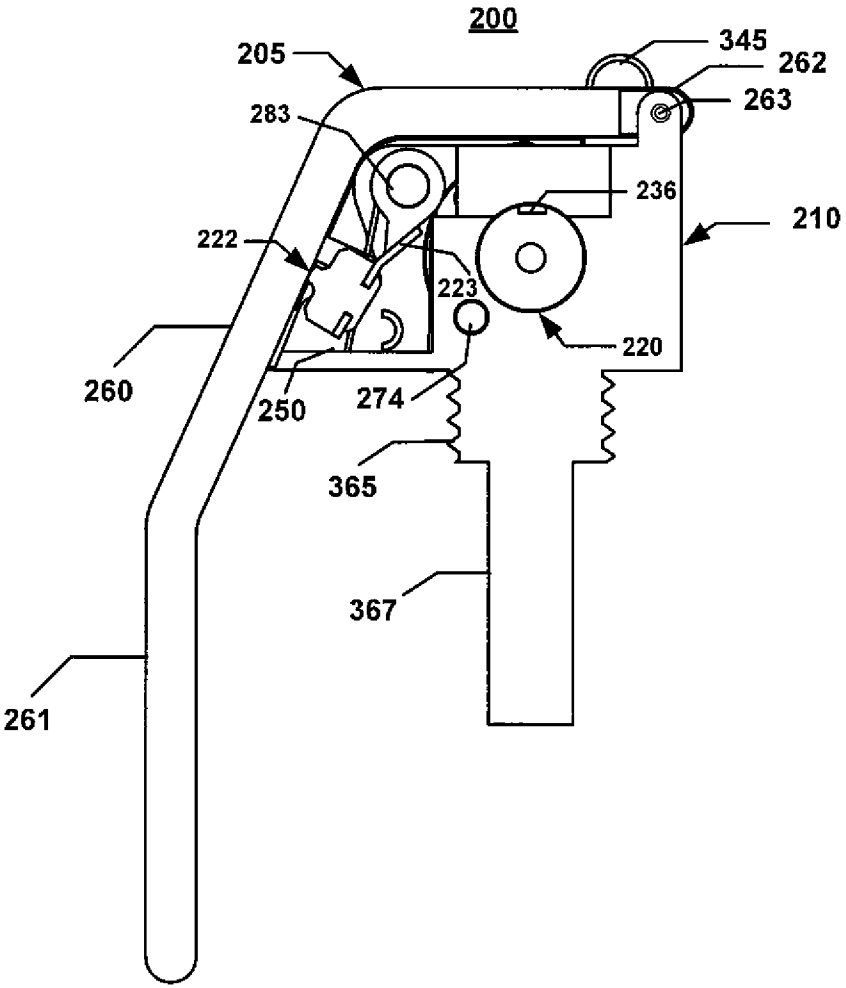
FIG. 5D is a side elevational view of the safety fuze with certain components removed for clarity of illustration.

As illustrated in FIG. 5, and more specifically FIG. 5D, the rotation of the thumb switch assembly 350 causes the initiating device and/or delay device 355 to rotate so that the target 236 becomes in-line with the point of contact 280 of the striker assembly 279, and the lever 205 will no longer be restrained.

In this armed state, the target 236 of the initiator 351 is now rotated to be along the path of travel of the point of contact 280 of the striker assembly 279 should the striker 222 be released, making the explosive train in-line.

The rotation of the thumb switch assembly 350 also causes the red visual safe mode indicator 273 (FIGS. 5A, 5B, 5D) to appear, so that it provides the user with a confirmation of the armed, initiated state of the fuze 200. The two thumb levers 345, 346 are in the upward position.

Figure 6B:
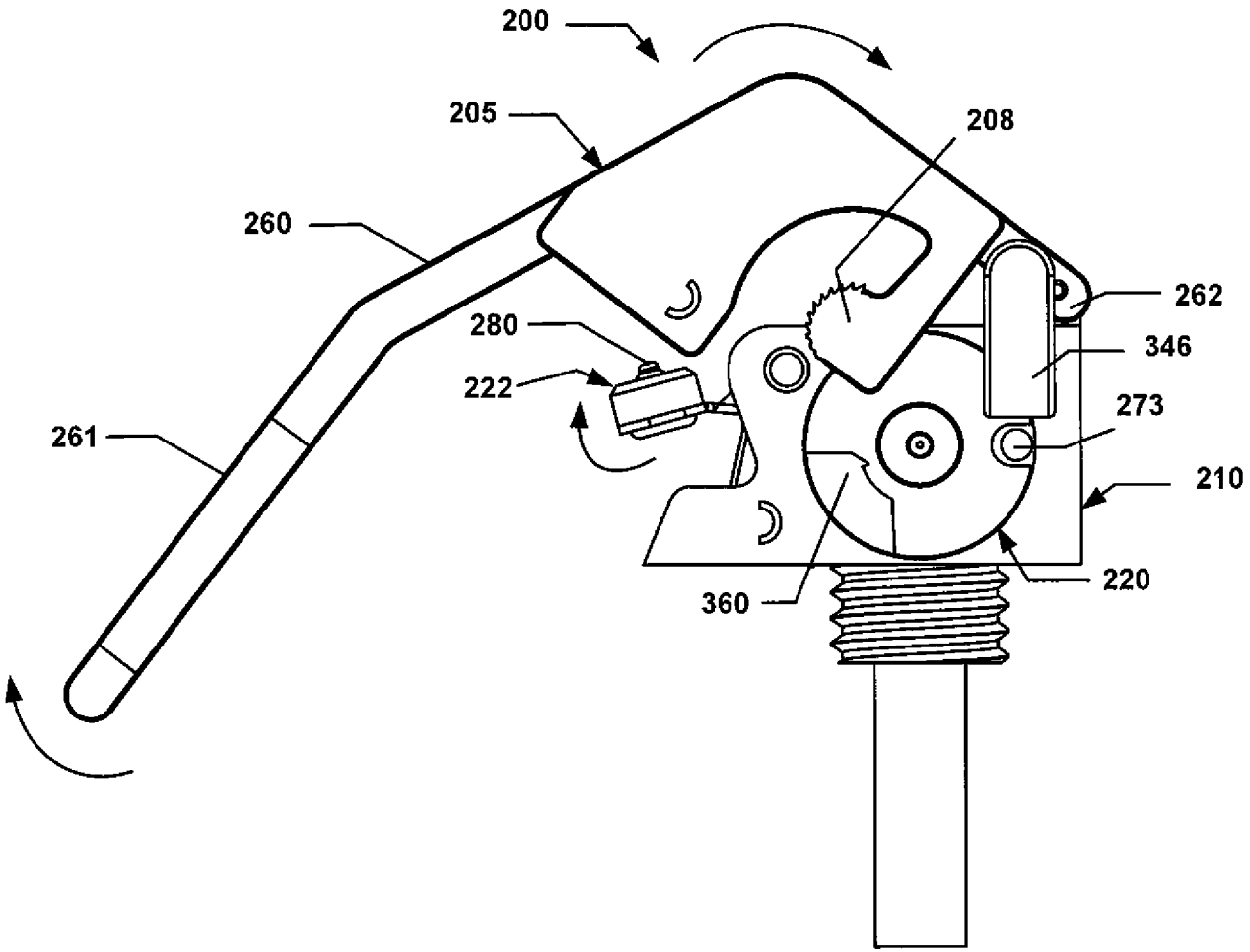
Figure 6C:
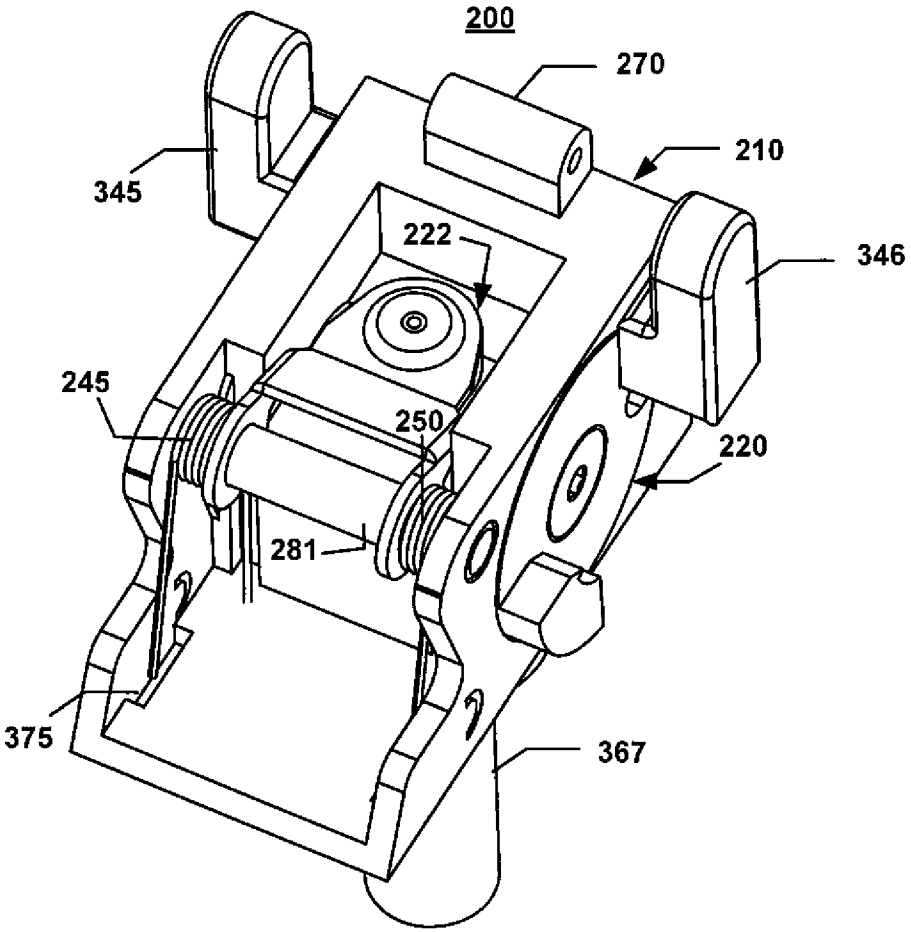

The initiation state of the safety fuze 200 is shown in step 140 of FIG. 1B and FIG. 6. The user releases the lever 205, allowing the lever 205 to move unrestrained. This will cause the rotation of the striker pivot point of contact 280 to make contact with the initiating device 355. At this stage, the safety fuze 200 is armed, and has initiated the delay and primary explosive 355.

As illustrated in FIG. 6, the release of the lever 205 causes the striker spring 258 to act against, and to force the striker 222 to be projected upward, in a rotary movement, around the axis of the rod 281 (FIG. 2).

Figure 7:
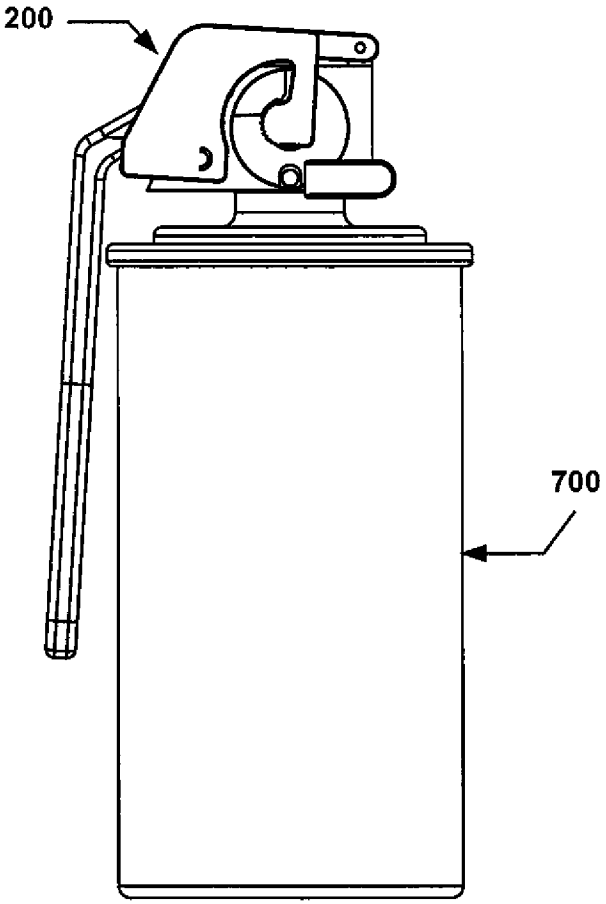
FIG. 7 is a side elevational view of the safety fuze of FIG. 2 shown mounted on a cylindrical canister.

It should be understood that other modifications may be made to the present design without departing from the spirit and scope of the invention. According to an alternative embodiment illustrated in FIG. 7, the safety fuze 200 is mounted on a cylindrical canister or grenade 700, rather than the generally spherical grenade 300. It should be understood that the canister or cartridge may have different shapes or dimensions than those illustrated herein.

While the rotating switch assembly 350 has been described in a preferred embodiment as containing an initiation and/or delay device 355, it should be understood that the initiation and/or delay device 355 may be any of an explosive or a non-explosive device. As an example, commercial applications may require the use of a firing pin or similar other devices.

An optional feature that is exemplified in FIGS. 3A and 3E, is a remote or delayed initiation feature of the safety fuze 200, wherein the use is not required to throw the grenade 300. According to this alternative embodiment, the flanges 212 and 214 of the lever 205 include two openings 600, and the safety fuze body 210 includes two generally similar openings 610. When the safety fuze 200 is set to either the armed state of step 130 (FIG. 1A), then the openings 600 and 610 are aligned on both sides of the safety fuze body 210. A pin (or another component) may be inserted in the openings of either one or both sides of the safety fuze body 210, so that a sudden removal of the pin will release the lever 205 as described earlier in relation to the initiation state of step 140 (FIG. 1B).

In a preferred embodiment, the lever platform 260 integrally extends into the lever handle 261 at an angle of approximately 20 degrees. It should be understood that the angular disposition of the lever platform 260 and the lever handle 261 may vary with the intended application. In addition, in alternative embodiments, the lever platform 260 and the lever handle 261 are not necessarily, rigidly connected to each other.

Although the present safety fuze 200 has been described in connection with one exemplary military application, it should be clear that the safety fuze 200 may have multiple commercial applications, including but not limited to: law enforcement, riot control, rescue operations, illumination, and pest control.

What is claimed is:

1. A safety fuze comprising:

a body;

a lever that is rotatably secured to one end of the body;

a striker assembly that is rotatably secured to another end of the body; and a thumb switch assembly that includes a target and that is rotatably secured to the body;

wherein when the safety fuze is in a safe-locked state:

the striker assembly is held in position by the lever;

the thumb switch assembly is interlocked with the lever; and the target of the thumb switch assembly is rotated out of a rotation path of the striker assembly.

2. The safety fuze according to claim 1, wherein a depression of the lever causes the thumb switch assembly to become disengaged from the lever, setting the safety fuze in a safe-unlocked state.

3. The safety fuze according to claim 2, wherein a release of the lever causes the safety fuze to return to the safe-locked state.

4. The safety fuze according to claim 2, wherein as the lever is depressed, a rotation of the thumb switch assembly in a predetermined direction causes the target to rotate within the rotation path of the striker assembly, setting the safety fuze in an armed state.

5. The safety fuze according to claim 4, wherein a rotation of the thumb switch assembly in an opposite direction, followed by a release of the lever, cause the safety fuze to return to the safe-locked state.

6. The safety fuze according to claim 4, wherein a release of the lever causes the striker assembly to rotate and to make contact with the target, setting the safety fuze in an initiation state.

7. The safety fuze according to claim 1, wherein the thumb switch assembly includes an initiator.

8. The safety fuze according to claim 7, wherein the initiator includes an initiation device.

9. The safety fuze according to claim 1, wherein the thumb switch assembly includes two generally thumb switches, to enable an ambidextrous use of the safety fuze.

10. The safety fuze according to claim 1, further comprising a visual indicator; and wherein the visual indicator varies in color, depending on the position of the thumb switch assembly.

11. A method of using a safety fuze having a body and a lever, the method comprising:

rotatably securing the lever to one end of the body;

rotatably securing a striker assembly to another end of the body; and rotatably securing a thumb switch assembly to the body, wherein the thumb switch assembly includes a target;

wherein when the safety fuze is in a safe-locked state:

the striker assembly is held in position by the lever;

the thumb switch assembly is interlocked with the lever; and the target of the thumb switch assembly is rotated out of a rotation path of the striker assembly.

12. The method according to claim 11, further includes causing the thumb switch assembly to become disengaged from the lever to set the safety fuze in a safe-unlocked state, by depressing the lever.

13. The method according to claim 12, further includes causing the safety fuze to return to the safe-locked state by releasing the lever.

14. The method according to claim 12, further includes causing the target to rotate within the rotation path of the striker assembly, and to set the safety fuze in an armed state, by depressing the lever and rotating the thumb switch assembly in a predetermined direction.

15. The method according to claim 14, further includes causing the safety fuze to return to the safe-locked state, by rotating the thumb switch assembly in an opposite direction, and then releasing the lever.

16. The method according to claim 14, causing the striker assembly to rotate and to make contact with the target, to set the safety fuze in an initiation state, by releasing the lever.

17. The method according to claim 11, wherein the thumb switch assembly includes an initiator.

18. The method according to claim 17, wherein the initiator includes an initiation device.

19. The method according to claim 11, wherein the thumb switch assembly includes two generally thumb switches, to enable an ambidextrous use of the safety fuze.

20. The method according to claim 11, further comprising a visual indicator; and wherein the visual indicator varies in color, depending on the position of the thumb switch assembly.

* * * * *